US005364719A

United States Patent [19]

Ohta et al.

[11] Patent Number: 5,364,719

[45] Date of Patent: Nov. 15, 1994

[54] TONER FOR DEVELOPING ELECTROSTATIC IMAGES

[75] Inventors: Hideki Ohta, Ikoma; Tatsuo Imafuku, Higashiosaka; Masami Tsujihiro, Katano; Toshiro Tokuno, Takarazuka; Hiroshi Shimoyama; Nobuhiro Hirano, both of Osaka, all of Japan

[73] Assignee: Mita Industrial Co., Ltd., Osaka, Japan

[21] Appl. No.: 23,857

[22] Filed: Feb. 24, 1993

Related U.S. Application Data

[63] Continuation of Ser. No. 619,577, Nov. 29, 1990, abandoned.

[30] Foreign Application Priority Data

Nov. 30, 1989 [JP] Japan ..... 1-312506

[51] Int. Cl.[5] ..... G03G 9/09

[52] U.S. Cl. ..... 430/106; 430/109; 430/110; 430/904; 430/106.6

[58] Field of Search ..... 430/106, 109, 904, 110, 430/106.6, 115

[56] References Cited

U.S. PATENT DOCUMENTS

| | | | |
|---|---|---|---|
| 4,547,449 | 10/1985 | Alexandrovich et al. | 430/115 |
| 4,777,104 | 10/1988 | Matsumoto et al. | 430/109 |
| 4,937,157 | 6/1990 | Haack et al. | 430/110 |
| 4,950,575 | 8/1990 | Shiozaki et al. | 430/110 |
| 4,950,575 | 8/1990 | Shiozaki et al. | 430/110 |

FOREIGN PATENT DOCUMENTS

| | | |
|---|---|---|
| 0203818 | 12/1986 | European Pat. Off. . |
| 0276963 | 8/1988 | European Pat. Off. . |
| 0330287 | 8/1989 | European Pat. Off. . |
| 2083051 | 3/1982 | United Kingdom . |

*Primary Examiner*—Marion E. McCamish
*Assistant Examiner*—Rosemary Ashton
*Attorney, Agent, or Firm*—Armstrong, Westerman, Hattori, McLeland & Naughton

[57] ABSTRACT

Toner for developing electrostatic images contains at least a colorant and a charge control dye in a binding resin which is the main component thereof, the toner having a surface dye density of less than $5\times10^{-3}$ g/g and containing a monomer having a charge control polar group within the range of 0.01 to 5 weight percent based on the weight of the toner. The binding resin is preferably formed from at least one kind of monomer selected from a group consisting of vinyl aromatic monomers, acrylic type monomers, vinyl ester type monomers, vinyl ether type monomers, diolefin type monomers and monoolefin type monomers, and further preferably from at least one kind of monomer selected from a group consisting of styrene, ester acrylate and ester methacrylate. Also, the binding resin may be formed from at least one kind of monomer selected from a group consisting of polyester, phenol and epoxy resins. It is desirable that the colorant be used in 0.1 to 50 parts by weight for every 100 parts by weight of the polymerizable monomer. A magnetic pigment may also be used in addition to or instead of the colorant. In this case, it is desirable that the magnetic pigment be used in 1 to 200 parts by weight, and preferably in 5 to 100 parts by weight, for every 100 parts by weight of the polymerizable monomer.

10 Claims, No Drawings

TONER FOR DEVELOPING ELECTROSTATIC IMAGES

This application is a continuation of application Ser. No. 07/619,577 filed Nov. 29, 1990, now abandoned.

BACKGROUND OF THE INVENTION

1. Field of the Invention

The present invention relates to toner used in an image forming apparatus such as an electrophotographic copying machine or the like for developing electrostatic images, and more particularly to toner for developing electrostatic images, which has stable frictional charge characteristics and which does not contaminate the surface of a frictional charging material such as carrier or the like.

2. Description of the Prior Art

In an image forming apparatus such as an electrophotographic copying machine or the like, a two-component developer comprising fine particle toner and frictional charging material such as magnetic carrier or the like is usually used as a developer to make visible by a dry developing process an electrostatic latent image formed on a photoconductor. When such a two-component developer is mixed together by a fixed-type mixer, the toner is charged by friction with the carrier and adheres uniformly on the surface of the carrier. Generally, the toner contains colored resin particles of 5 to 20 μm in size that are prepared by dispersing a colorant into a binding resin medium. As the binding resin that forms the toner, a resin is used, for example a styrene type resin, which has desired charging and binding characteristics for fixing the colorant to the surface of a sheet made of paper or other material. The colorants used include carbon black and other organic or inorganic coloring dyes. The main components of the toner, i.e. the colorant, the binding resin, etc., have respectively intrinsic polarities and charging characteristics, but by themselves they are not enough for developing an electrostatic latent image formed on the photoconductor. Therefore, a charge control dye (hereinafter abbreviated as CCA) is generally added in a small quantity to the toner. The CCAs used for this purpose include nigrosine; monoazo dyes; metallic complexes of salicylic acid or naphthoic acid; and so forth.

The CCA is used to activate the generation of electrostatic charges in the toner and thereby to enhance the saturation charge amount thereof. It is therefore desirable that the CCA exist on the surfaces of toner particles in view of charging through friction with the frictional charging material such as the carrier or the like. However, since most CCAs are hydrophilic, it is hard to say that the CCAs have good compatibility with the binding resin, therefore they are not uniformly dispersed in the toner. Nonuniform dispersion of the CCA results in inconsistent charge characteristics of the toner. Moreover, if the CCA existing on the surfaces of toner particles falls off and adheres to the surfaces of carrier particles, they will cause the surfaces of carrier particles to become contaminated. This leads to a phenomenon during a continuous copying operation, in which, although the initial image may be produced in good condition, the charge amount of toner gradually decreases involving an increase in the image density and eventually causing such problems as dust collection on the ends of the carrier particles.

Reducing the amount of the CCA to be used may be considered as a possible solution to the problem caused by the nonuniform dispersion of the CCA and to the problem of the carrier surface contamination by the CCA. However, when the amount of the CCA to be used is reduced, the frictional charge efficiency of the toner decreases and the saturation charge amount thereof also decreases. A decreased frictional charge efficiency means increased time is required for the toner to be charged to a prescribed amount, which, in particular, causes the problem of the splashing of uncharged toner during a continuous copying operation, thus impairing the quality of the images produced.

SUMMARY OF THE INVENTION

The inventors, have found that by reducing the amount of the CCA and having the binding resin contain monomer components having polar groups, the time required for charging the toner to a prescribed amount is shortened, which further helps stabilize the charge characteristics of the toner, and thus have completed the present invention.

The toner for developing electrostatic images of the present invention contains at least a colorant and a charge control dye in a binding resin which is the main component, the toner having a surface dye density of less than $5\times10^{-3}$ g/g and containing a monomer having a charge control polar group within the range of 0.01 to 5 parts by weight based on the weight of the toner.

In a preferred embodiment, the binding resin is formed from at least one kind of monomer selected from a group consisting of vinyl aromatic monomers, acrylic monomers, vinyl ester monomers, vinyl ether monomers, diolefin monomers and monoolefin monomers.

In a preferred embodiment, the binding resin is formed from at least one kind of monomer selected from the group consisting of styrene, acrylic esters and methacrylic esters.

In a preferred embodiment, the binding resin is formed from at least one kind of monomer selected from the group consisting of polyesters, phenol resins and epoxy resins.

In a preferred embodiment, the colorant is contained in an amount of 0.1 to 50 parts by weight for every 100 parts by weight of the monomers.

A magnetic pigment can be contained in addition to or instead of the colorant.

In this case, the magnetic pigment is preferably contained in 1 to 200 parts by weight, more preferably 5 to 100 parts by weight for every 100 parts by weight of the monomer.

In a further preferred embodiment, the charge control dye is soluble in alcohol.

In a preferred embodiment, the monomer having a charge control polar group is at least one kind of monomer selected from a group consisting of styrene-sulfonic acid, sodium styrene sulfonate and 2-acrylamid-2-methylpropane sulfonic acid.

Thus, the invention described herein makes possible the objectives of (1) providing toner having a reduced amount of charge control dye which may contaminate a frictional charging material such as carrier or the like, without adversely affecting the desired charge characteristics; (2) providing toner having a high charge efficiency and requiring a reduced time for charging to a prescribed amount; (3) providing toner whose charge amount does not decrease even when the image forming apparatus is operated continuously; (4) providing a long-life developer using the toner of the invention; and (5) providing toner which is inexpensive to manufacture, by reducing the using amount of expensive charge control dye.

DESCRIPTION OF THE PREFERRED EMBODIMENTS

Monomers capable of addition polymerization are used as the polymerizable monomers that forms the binding resin. These monomers include vinyl aromatic monomers, acrylic monomers, vinyl ester monomers, vinyl ether monomers, diolefin monomers, monoolefin monomers, etc.

The vinyl aromatic monomers used are expressed by the following general formula (1).

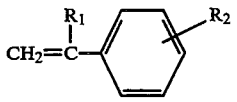

(1)

In the formula, $R_1$ represents a hydrogen atom, a lower alkyl group or a halogen atom, and $R_2$ denotes a hydrogen atom, a lower alkyl group, a halogen atom, an alkoxy group, a nitro group or a vinyl group.

To describe specifically, such monomers include styrene, α-methylstyrene, vinyltoluene, α-chlorostyrene, o-, m-, p-chlorostyrene, p-methyl styrene, and divinylbenzene.

The acrylic monomers used are expressed by the following general formula (2).

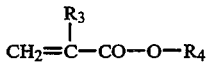

(2)

In the formula, $R_3$ represents a hydrogen atom or a lower alkyl group, and $R_4$ denotes a hydrogen atom, a hydrocarbon radical having 1 to 12 carbon atoms, a hydroxyalkyl group or a vinyl ester group.

To describe specifically, such monomers include methyl acrylate, ethyl acrylate, butyl acrylate, 2-ethylhexyl acrylate, cyclohexyl acrylate, phenyl acrylate, methyl metacrylate, hexyl methacrylate, 2-ethylhexyl methacrylate, ethyl β-hydroxyacrylate, propyl γ-hydroxyacrylate, butyl δ-hydroxyacrylate, ethyl β-hydroxyacrylate, ethylene glycol dimethacrylate, tetraethylene glycol dimethacrylate, etc.

The vinyl ester monomers used are expressed by the following general formula (3).

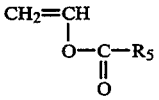

(3)

In the formula, $R_5$ represents a hydrogen atom or a lower alkyl group.

To describe specifically, such monomers include vinyl formate, vinyl acetate, vinyl propionate, etc.

The vinyl ether monomers used are expressed by the following general formula (4).

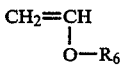

(4)

In the formula, $R_6$ represents a hydrocarbon radical having 1 to 12 carbon atoms.

To describe specifically, such monomers include vinyl-n-butylether, vinylphenylether, vinylyclohexylether, etc.

The diolefin monomers used are expressed by the following general formula (5).

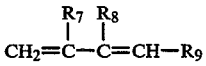

(5)

In the formula, $R_7$, $R_8$, and $R_9$ respectively represent a hydrogen atom, a lower alkyl group or a halogen atom.

To describe specifically, such monomers include butadiene, isoprene, chloroprene, etc.

The monoolefin monomers used are expressed by the following general formula (6).

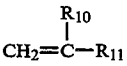

(6)

In the formula, $R_{10}$ and $R_{11}$ respectively represent a hydrogen atom or a lower alkyl group.

To describe specifically, such monomers include ethylene, propylene, isobutylene, butene-1, pentene-1, 4-methylpentene, etc.

Either one kind or a combination of two or more kinds of the above-mentioned monomers can be used. From the viewpoint of the fixing characteristics of a resultant toner, it is desirable that at least one selected from a group consisting mainly of styrene, acrylic ester and methacrylic ester is used as the monomer.

Polyester resins, phenol resins, epoxy resins or the like can be used besides the resins formed from the above-mentioned monomers capable of addition polymerization.

Monomers having polar groups for charge control, i.e. monomers containing anion groups include maleic anhydride, crotonic acid, tetrahydromaleic anhydride, styrenesulfonic acid, and 2-acrylamide-2-methylpropanesulfonic acid. Monomers containing cation groups include dimethylaminoethyl(meth)acrylate, diethylaminoethyl(meth)acrylate, N-aminoethyl aminopropyl(meth)acrylate, vinylpyridine, 2-vinylimidazole, 2-hydroxy-3-acryloxy propane, and trimethylammonium chloride. These monomers having polar groups for charge control, i.e. monomers containing charge control polar groups, are added in 0.01 to 5 weight percent with respect to the weight of the toner. If the percentage is larger than 5 weight percent, the moisture resistance decreases since the polar groups are hydrophilic. If the percentage is lower than 0.01 weight percent, the effects of the present invention cannot be obtained.

As to the colorant contained in the toner of the present invention, any of the known pigments and dyes (hereinafter simply referred to as color pigments) examples of which are shown below and which are generally used in this field can be used.

Black pigment

Carbon black, acetylene black, lamp black, and aniline black.

Yellow pigment

Chrome yellow, zinc yellow, cadmium yellow, yellow iron oxide, mineral fast yellow, nickel titanate, Naple's Yellow, Naphtol Yellow S, Hanza Yellow 107G, benzidine yellow G, Quinoline Yellow Lake, Permanent Yellow NGG, and tertrazin lake.

Orange pigment

Chrome Orange, molybdenum orange, Permanent Orange GTR, Pyrazorone Orange, Vulcan Orange, indanthrene brilliant orange RK, benzidine orange G, and indanthrene brilliant orange GK.

Red pigment

Red iron oxide, cadmium red, red lead, cadmium mercury sulfide, Permanent Orange 4R, pyrazorone red, Lithol Red, Watchung Red calcium salt, Lake Red D, Brilliant Carmine 6B, Eosine Lake, Rhodamine Lake Alizarin Lake, and Brilliant Carmine 3B.

Violet pigment

Manganese Violet, Fast Violet B, and Methylviolet Lake.

Blue pigment

Iron blue, cobalt blue, American blue lake, Victoria Blue Lake, Phthalocyanine Blue, Metal-Free Phthalocyanine Blue, partially chlorinated Phthalocyanine Blue, Fast Sky Blue, and indanthrene blue BC.

Green pigment

Chrom green, chromium oxide, Pigment Green B, Malachite Green Lake, and Final Yellow Green G.

White pigment

Zinc white, titanium dioxide, antimony white, and zinc sulfide.

Body extender pigment

Pearlite powder, barium carbonate, clay, silica, white carbon, talc, and alminum white.

These color pigments are used in 0.1 to 50 parts by weight, and preferably in 1 to 20 parts by weight, for every 100 parts by weight of the previously mentioned polymerizable monomers.

If the above toner is a magnetic toner, a magnetic pigment may be used in addition to or instead of the color pigments.

As for magnetic material pigments, particle powders made of known magnetic materials are used. Examples of the pigments include triiron tetroxide ($Fe_3O_4$), iron sesquioxide ($\gamma$-$Fe_2O_3$), zinc ferrite ($Zn\ Fe_2O_4$), yttrium ferrite ($Y_3Fe_5O_{12}$), cadmium ferrite ($Cd_3Fe_5O_{12}$), copper ferrite ($CuFe_2O_4$), lead ferrite ($PbFe_{12}O_{19}$), manganese ferrite ($MnFe_2O_4$), neodymium ferrite ($NdFO_3$), barium ferrite ($BaFe_{12}O_{19}$), magnesium ferrite ($MgFe_2O_4$), lanthanum ferrite ($LaFeO_3$), iron powder (Fe), cobalt powder (Co), and nickel powder (Ni).

It is desirable that these magnetic pigments be added in 1 to 200 parts by weight, and preferably in 5 to 100 parts by weight, for every 100 parts by weight of the previously mentioned polymerizable monomers.

As for the above-mentioned dye for charge control (hereinafter referred to as CCA), well-known CCA used in this field, for example, an oil soluble dye such as Nigrosine Dye, Oil Black, and Spyrone Black; a metallic soap which is a metallic salt (e.g. manganese salt, iron salt, cobalt salt, nickel salt, lead salt zinc salt, cerium salt, or calcium salt) of naphthenic acid, salicylic acid, octanoic acid, higher fatty acid, resin acid; metal-containing azo dyes; pyrimizine compound; metal chelate of alkylsalicylic acid; etc. can be used. Especially, alcohol soluble CCA is preferably used.

Such CCAs are added in such a way as to give a surface dye density of less than $5\times10^{-3}$ g/g with respect to 1 g of toner. If the density is $5\times10^{-3}$ g/g or higher, it may cause contamination of the carrier surface. In particular, if the density is less than $1\times10^{-5}$ g/g, the saturation charge amount of the toner shows a tendency to drop, which is not desirable. When the surface dye density is kept within the above range by having the monomers with charge control polar groups contained in the toner within the previously mentioned range, desirable charge characteristics can be provided.

A polymer containing the polar groups is a homopolymer consisting of a monomer having the previously mentioned polar group or a copolymer consisting of a monomer having a polar group and an oil-soluble monomer capable of forming a polymer having good compatibility with the binding resin. The polymer containing the polar groups are synthesized by the well-known polymerization method, and the polymer thus obtained is blended in the composition for toner. When the toner is manufactured by suspension polymerization which is hereinafter described, the polymer having polar groups can exist in a state bound to or encased in the binding resin. The resulting toner particles have monomers having polar groups uniformly dispersed therein and therefore are easily charged. This results in a reduced time required for the toner to be charged to a prescribed amount. Also, since the monomers having charge control polar groups exist in a state bound to or encased in the binding resin within the toner particles, stable charge characteristics are provided.

In the above toner, various known compounding agents generally used in this field may be mixed.

For example, low-molecular weight polypropylene, low-molecular weight polyethylene, and waxes such as paraffin waxes; olefin type polymers having a 4 or more carbons; fatty amides; and silicone oil, etc. may be preferably used as offset preventives in 0.1 to 10 parts by weight for every 100 parts by weight of the polymerizable monomers.

A method for manufacturing the toner for developing electrostatic images is now described.

The toner of the present invention is advantageously manufactured by suspension polymerization.

A polymerizable composition consisting of the polymerizable monomers with various compounding agents mixed therein is polymerized while dispersed in suspension. As the dispersion stabilizers used to disperse the polymerizable composition in water for suspension therein, known dispersion stabilizers generally used for suspension polymerization may be used, but from the viewpoint of stability of particles and easy removal from polymer particles after polymerization, inorganic dispersing agents are desirable. In particular, inorganic salt fine particles substantially insoluble in water are preferably used. To describe specifically, such dispersing agents include calcium sulfate, tribasic calcium phosphate, magnesium carbonate, barium carbonate, calcium carbonate, aluminum hydroxide, silica, etc. Such dispersing agents should be used in 0.001 to 10 parts by weight, and preferably in 0.005 to 5 parts by weight, for every 100 parts by weight of water.

Polymerization initiator is preferably added when polymerization reaction is carried out. Oil soluble polymerization initiators are preferably used; the initiators include azo compounds such as azobisisobutyronitrile;

and peroxides such as cumene hydroperoxide, t-butylhydroperoxide, dicumyl peroxide, di-t-butylhydroperoxide, benzoyl peroxide and lauroyl peroxide. Instead of using such initiators, ionization radioactive rays such as gamma rays or accelerated electron beam, or a combination with various photosensitizers may be used.

Reaction conditions can be selected as considered appropriate. The stirring speed for generating dispersed oil droplets is generally 3,000 to 200,000 rpm, and preferably within the range of 5,000 to 15,000 rpm. The stirring is performed in such a way as to generate suspended oil droplets of 5 to 11 μm particle size, but preferably 7 to 10 μm particle size. The mixing ratio of the polymerization initiator should be determined as considered appropriate as a catalyst. Generally, 0.1 to 10 weight percent is desirable with respect to the monomer charged. The polymerization initiating temperature and polymerization time should be the same as those adopted for conventional suspension polymerization. Generally, polymerization for 1 to 50 hours at 40° to 100° C. will suffice. Also, the reaction mixture should be stirred mildly so as to cause a uniform reaction throughout the system. The polymerization may be performed under an inert gas (e.g. nitrogen) atmosphere to prevent the polymerization from being deterred by oxygen. The resulting polymer after the reaction is filtered to separate solids from liquid, and the thus separated polymer is washed and treated with dilute acid, etc. to obtain toner particles.

In the case of manufacturing toner by the suspension polymerization, the polymer containing the monomers having charge control polar groups should preferably be in the form of a copolymer consisting of an oil soluble-monomer compatible with an oil-soluble monomer forming the binding resin and a monomer having a polar group, the composition ratio (of the oil-soluble monomer to the monomer containing a polar group) being preferably within the range of 9:1 to 5:5. When the composition ratio is greater than the above range with a greater proportion of the monomer containing a polar group, there is a possibility that the copolymer may drop off the suspended oil droplets during the polymerization reaction.

According to the above suspension polymerization process, nearly spherical toner can be obtained. The toner having Wadel's practical spheroidicity of 0.95 to 1.0 exhibits good flowability and remarkable charging effects.

Instead of the above polymerization method, spray drying can be used to manufacture the toner of the present invention. That is, a polymer containing a binding resin such as a styrene-acrylic copolymer, polyester resin, epoxy resin, etc., a colorant, a CCA, and a monomer having a polar group is dissolved or dispersed in an organic solvent such as toluene or the like, and the solution is sprayed and dried to obtain spherical toner particles.

Also, the toner of the present invention is not limited to spherical toner but may be irregular shaped toner manufactured by grinding. In this case, the toner of the present invention is manufactured by melting and kneading a polymer containing a binding resin, a colorant, a CCA and a monomer having a polar group and by classifying the kneaded composition. In the thus obtained toner, monomers having charge control polar groups are uniformly dispersed.

The toner of the present invention is mixed with a carrier used in a conventional dry development process, thus producing a two-component developer.

In the present invention, the surface dye density was obtained in the following manner. Precisely 100 mg of toner was measured, to which 50 ml of methanol was added, and the mixture was stirred for 10 minutes by a ball mill and was left for 24 hours. After that, the density of the supernatant liquid was measured using an absorptiometer to calculate the density using Lambert-Beer's law.

EXAMPLES

The present invention is now described in detail by way of examples.

Example 1

Eighty parts by weight of styrene, 20 parts by weight of 2-ethylhexyl methacrylate, 0.1 parts by weight of charge control dye Sprone Black TRH (Brand name for metal-containing monoazo dye manufactured by Hodogaya Kagaku), 1 part by weight of styrene-sodium styrene sulfonate copolymer (Composition ratio of 9:1), 5 parts by weight of grafted carbon black, 0.8 parts by weight of divinylbenzene, and 2 parts by weight of low-molecular polypropylene were thoroughly dispersed using a ball mill, and 5 parts by weight of polymerization initiator 2,2'-azobis-2,4-dimethylvaleronitrile was dissolved in the dispersion.

Thereafter, the mixture of the above composition was put into an aqueous phase consisting of 400 parts by weight of water, 6 parts by weight of tribasic calcium phosphate, and 0.05 parts by weight of sodium dodecylbenzene sulfonate and was stirred for 10 minutes by a TK homomixer for dispersion and suspension in the aqueous phase. The thus prepared mixture was polymerized for 10 hours at 75° C. until the reaction was completed. The resultant polymer was filtered, washed, and dried to obtain toner of an average particle size of 9 μm. This toner is herein denoted as Toner 1. The surface dye density of this toner was $7\times10^{-4}$ g/g. Hydrophobic silica and alumina were added in suitable quantities to 100 parts by weight of toner particles to prepare a toner composition, which was then mixed with ferrite carrier so that a toner density of 3% was obtained. The thus prepared developer was subjected to copying tests of 20,000 sheets on an electrophotographic copying machine DC-1205 (Model name of Mira Industral Co., Ltd.). The results are shown in Table 1.

Further, as shown in Table 1, Toner 2, Toner 3, and Toner 4 were prepared by changing the mixing proportions of charge control dye and styrene-sodium styrene sulfonate copolymer, and copying tests of 20,000 sheets were conducted in the same manner as for Toner 1.

TABLE 1

| | Toner 1 | Toner 2 | Toner 3 | Toner 4 |
|---|---|---|---|---|
| Charge Control Dye (Parts) | 0.1 | 0.1 | 0.1 | 1 |
| Surface Dye Density (g/g) | $7\times10^{-4}$ | $7\times10^{-4}$ | $7\times10^{-4}$ | $7\times10^{-3}$ |
| Sodium Styrene Sulphonate (%) | 0.09 | 0.06 | 0.007 | 0.009 |
| Initial stage of copying | | | | |
| Image density | 1.40 | 1.44 | 1.48 | 1.42 |
| Fogging density | 0.002 | 0.002 | 0.002 | 0.005 |
| TEC (−μc/g) | 20.5 | 21.7 | 19.6 | 23.2 |
| Chargeability | Good | Good | Poor | Good |

TABLE 1-continued

| | Toner 1 | Toner 2 | Toner 3 | Toner 4 |
|---|---|---|---|---|
| 20,000 sheets | | | | |
| Image density | 1.43 | 1.45 | 1.53 | 1.52 |
| Fogging density | 0.002 | 0.003 | 0.007 | 0.009 |
| TEC ($-\mu c/g$) | 21.0 | 20.5 | 16.3 | 15.1 |
| Chargeability | Good | Good | Poor | Poor |

In Table 1, TEC, parts and % denote charge in the toner, parts by weight, and % by weight respectively.

As is apparent from Table 1, with toners having a surface dye density and styrene sodium sulphonate within a desirable range, good images were obtained throughout the copying of 20,000 sheets. On the other hand, with Toner 3, the chargeability was bad because the content of the monomer containing a polar group was low. With Toner 4, since the surface dye density was too high, the carrier surface was contaminated and foggings occurred frequently.

Example 2

One hundred weight parts of styrene-acrylate copolymer as the binding resin, 8 parts by weight of carbon black as the colorant, 0.2 parts by weight of charge control dye, Bonton S-34 (Brand name for metal-containing monoazo dye manufactured by Orient Chemical), 2 parts by weight of low-molecular polypropylene, and 0.5 parts by weight of styrene-sodium styrene sulfonate copolymer (Composition ratio of 8:2) were mixed, and the mixture was melted, kneaded, cooled, ground, and classified by conventional procedures, to obtain a toner of an average particle size of 8.5 $\mu$m. The surface dye density of this toner was $3\times10^{-3}$ g/g. The density of the monomer containing a polar group was 0.2%.

Next, 0.1 parts by weight of hydrophobic silica was added to 100 parts by weight of toner particles to prepare a toner composition, which was then mixed with ferrite carrier so that a toner density of 3.5% was given. The thus prepared developer was subjected to the same copying tests as in Example 1. High-density, clear images were produced both at the initial stage of copying and at the end of 20.000 copies. No carrier surface contamination was noted.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A toner for a two-component developer used for a dry development process with a carrier, comprising a colorant, a charge control dye and a copolymer having a charge control polar group in a binding resin, the binding resin being the main component of the toner; wherein said charge control dye is a metal-containing azo dye; said copolymer is obtained by copolymerizing sodium styrene sulfonate and styrene; the toner having a surface dye density of $1\times10^{-5}$ g/g to less than $5\times10^{-3}$ g/g to prevent a carrier surface contamination; and the toner containing an amount of said sodium styrene sulfonate as a component of said copolymer in a range of 0.01 to 5 parts by weight based on the weight of the toner.

2. Toner for developing electrostatic images according to claim 1, wherein said binding resin is formed from at least one kind of monomer selected from the group consisting of aromatic vinyl monomers, acrylic monomers, vinyl ester monomers, vinyl ether monomers, diolefin monomers and monoolefin monomers.

3. Toner for developing electrostatic images according to claim 1, wherein said binding resin is formed from at least one kind of monomer selected from the group consisting of styrene, acrylic esters and methacrylic esters.

4. Toner for developing electrostatic images according to claim 1, wherein said binding resin is formed from at least one kind of monomer selected from the group consisting of polyesters, phenol resins and epoxy resins.

5. Toner for developing electrostatic images according to claim 1, wherein said colorant is contained in an amount of 0.1 to 50 parts by weight for every 100 parts by weight of said monomers.

6. Toner for developing electrostatic images according to claim 1, containing a magnetic pigment in addition to or instead of said colorant.

7. Toner for developing electrostatic images according to claim 1, wherein said magnetic pigment is contained in an amount of 1 to 200 parts by weight for every 100 parts by weight of said monomer.

8. Toner for developing electrostatic images according to claim 7, wherein said magnetic pigment is contained in an amount of 5 to 100 parts by weight for every 100 parts by weight of said monomer.

9. Toner for developing electrostatic images according to claim 1, wherein said charge control dye is soluble in alcohol.

10. A toner according to claim 1, wherein said charge control dye is a metal-containing azo dye present in the amount of 0.1 weight % based on the weight of the toner.

* * * * *